US007073745B2

(12) United States Patent
Flis

(10) Patent No.: US 7,073,745 B2
(45) Date of Patent: Jul. 11, 2006

(54) APPARATUS, SYSTEM AND METHOD FOR DISPENSING PAPER FROM A PAPER ROLL

(75) Inventor: Joe E. Flis, Schenectady, NY (US)

(73) Assignee: Henry J. Kaminski, Jr., Schenectady, NY (US)

( * ) Notice: Subject to any disclaimer, the term of this patent is extended or adjusted under 35 U.S.C. 154(b) by 92 days.

(21) Appl. No.: 10/710,900

(22) Filed: Aug. 11, 2004

(65) Prior Publication Data

US 2004/0251376 A1 Dec. 16, 2004

Related U.S. Application Data

(63) Continuation of application No. PCT/US03/15291, filed on May 16, 2003, which is a continuation-in-part of application No. 10/063,841, filed on May 17, 2002, now abandoned.

(51) Int. Cl.
*B65H 49/00* (2006.01)

(52) U.S. Cl. ..... 242/588.6; 242/160.1

(58) Field of Classification Search ..... 242/588, 242/588.3, 588.6, 598.6, 160.1
See application file for complete search history.

(56) References Cited

U.S. PATENT DOCUMENTS

| | | | | |
|---|---|---|---|---|
| 640,543 A | | 1/1900 | Donning | 242/588.1 |
| 1,069,746 A | | 8/1913 | Watts | 242/588.1 |
| 1,107,747 A | * | 8/1914 | Bauer | |
| 1,212,020 A | | 1/1917 | Contant | 242/564 |
| 1,266,299 A | | 5/1918 | Moore | 401/52 |
| 1,322,966 A | | 11/1919 | Sinclair | 242/588.1 |
| 1,359,725 A | | 11/1920 | Moore | 401/52 |
| 1,431,722 A | | 10/1922 | Calvento | 401/51 |
| 1,716,249 A | * | 6/1929 | Taylor et al. | |
| RE17,645 E | * | 4/1930 | Barker et al. | |
| 1,833,999 A | * | 12/1931 | McCaskey | |
| 2,005,110 A | | 6/1935 | Ritzert | 281/5 |
| 2,031,033 A | * | 2/1936 | Wise | |
| 2,053,022 A | | 9/1936 | Corswandt et al. | 242/588.6 |
| 2,064,067 A | | 12/1936 | Knorr | 242/588 |
| 2,073,719 A | | 3/1937 | Ross | 242/55.2 |
| 2,076,035 A | | 4/1937 | Lar Riue, Jr. | 242/55.5 |
| 2,081,036 A | | 5/1937 | Gray | 129/1 |
| 2,111,362 A | | 3/1938 | Fisher | 40/108 |

(Continued)

FOREIGN PATENT DOCUMENTS

GB 1 403 321 * 8/1975

*Primary Examiner*—William A. Rivera
(74) *Attorney, Agent, or Firm*—Jay R. Yablon

(57) ABSTRACT

A paper roll dispensing apparatus in accordance with the invention comprises outer winding separation and inner winding restraint means for restraining inner windings of the paper roll from unrolling while simultaneously separating an outer winding of said paper roll from its inwardly-adjacent winding, and tension-supplying means for pressing a restraining edge of the outer winding separation and inner winding restraint means against an outside layer of the paper roll, both when the paper roll is substantially full and as the paper roll becomes depleted. Preferably, the paper roll also comprises tack adhesive means for adhering successive windings of the paper roll to one another when the outer winding is not pulled away from its inwardly-adjacent winding and simultaneously enabling the adhesion to be broken without substantial tearing of the paper when the outer winding is pulled away from its inwardly-adjacent winding. An embodiment in which induced curling of the paper is used to facilitate dispensing is also disclosed.

9 Claims, 5 Drawing Sheets

U.S. PATENT DOCUMENTS

| | | | | | |
|---|---|---|---|---|---|
| 2,224,470 | A | | 12/1940 | Boust | 242/55.2 |
| 2,287,618 | A | | 6/1942 | Josephs | 242/55.5 |
| 2,301,364 | A | | 11/1942 | Bruck et al. | 120/84 |
| 2,331,675 | A | | 10/1943 | Frost | 242/588.6 |
| 2,336,161 | A | * | 12/1943 | Blanchet | |
| 2,512,168 | A | | 6/1950 | Moore | 206/59 |
| 2,517,445 | A | | 8/1950 | Ruhland | 206/37 |
| 2,601,650 | A | | 6/1952 | Walet et al. | 242/55.5 |
| 2,783,878 | A | * | 3/1957 | Traver | |
| 3,140,059 | A | | 7/1964 | Lusebrink | 242/599 |
| 3,552,869 | A | | 1/1971 | Johnson | 401/195 |
| 3,949,947 | A | * | 4/1976 | Youngquist et al. | |
| 3,963,358 | A | | 6/1976 | Houser | 401/195 |
| 4,030,842 | A | | 6/1977 | White et al. | 401/195 |
| 4,239,164 | A | * | 12/1980 | Barnsbee et al. | |
| 4,327,875 | A | | 5/1982 | Lightfoot | 242/55.53 |
| 4,812,069 | A | | 3/1989 | White et al. | 401/195 |
| 4,872,775 | A | | 10/1989 | Chang | 401/52 |
| 4,874,139 | A | * | 10/1989 | Kewin | |
| 4,963,048 | A | | 10/1990 | Thomas et al. | 401/195 |
| 5,024,547 | A | | 6/1991 | Mui et al. | 401/195 |
| D329,459 | S | | 9/1992 | Sullivan | D19/36 |
| 5,158,384 | A | | 10/1992 | Radmilovic et al. | 401/195 |
| D338,036 | S | | 8/1993 | Sullivan | D19/36 |
| D346,619 | S | | 5/1994 | Ho | D19/36 |
| 6,135,661 | A | | 10/2000 | Houser | 401/195 |
| 6,247,864 | B1 | | 6/2001 | Walsh | 401/195 |
| 6,276,859 | B1 | | 8/2001 | Hsu | 401/195 |
| 6,283,661 | B1 | | 9/2001 | Connors | 401/195 |

* cited by examiner

APPARATUS, SYSTEM AND METHOD FOR DISPENSING PAPER FROM A PAPER ROLL

CROSS-REFERENCE TO RELATED APPLICATIONS

This application is a continuation the U.S. designation and election of application PCT/US03/15291 filed May 16, 2003; which in turn is a continuation-in-part of U.S. application Ser. No. 10/063,841 filed May 17, 2002, now abandoned.

BACKGROUND OF THE INVENTION

This invention relates generally to the field of writing implements such as pens and pencils combined with papers sources, and particularly to improving the mechanism by which paper is dispensed from the barrel of such a combined writing implement, or from a similar dispenser.

Devices combining a writing implement with a paper source have long been known in the art. One of the earliest such combined devices is disclosed in U.S. Pat. No. 640,543, which discloses a rolled strip of paper inside a tubular pencil case. Since then, a wide variety of combined writing implement and paper holding devices have sought to improve upon the basic ideas and mechanisms of U.S. Pat. No. 640,543. These include U.S. Pat. Nos. 1,359,725; 1,431,722; 2,005,110; 2,073,719; 2,076,035; 2,081,036; 2,224,470; 2,601,650; 3,963,358; 4,327,875; 4,872,775; 4,963,048; 5,024,547; 5,158,384; 6,135,661; Des. 329,459; Des. 346,619; and Des. 338,036.

U.S. Pat. No. 1,322,966 varies the idea of combining paper and a writing implement by placing a paper roll outside the writing implement as a separate attachment. U.S. Pat. No. 2,111,362 adds a rolled calendar to the basic writing implement. U.S. Pat. No. 2,301,364 discloses a pencil with a booklet contained therein. U.S. Pat. No. 2,517,445 dispenses a rolled ticker tape. U.S. Pat. No. 3,552,869 dispenses rolled stamps. U.S. Pat. No. 2,287,618 dispenses rolled toilet tissue. U.S. Pat. No. 4,030,842 discloses a flexible sheet which is extended from and retracted into a writing implement for storing information.

Several of these patents, for example, U.S. Pat. Nos. 1,431,722 and 2,512,168 also disclose a ratcheting or similar one-way mechanism to prevent paper from being rolled back into the writing implement once it has been unrolled out of the writing implement, which is generally desirable unless one of the goals is to roll the paper back into the writing implement, as is the case when the paper roll is used to store information (e.g., for the calendar of U.S. Pat. No. 2,111,362).

Helpful summaries of much of this prior art are provided in U.S. Pat. Nos. 4,812,069; 4,963,048; and 6,135,661.

One of the most important operational aspects of a combined writing implement/paper dispenser is the mechanism for dispensing the paper out from the writing implement. It is important to simultaneously prevent the paper from unrolling inside of the writing implement, while also making it easy for the paper to unroll when it desired to dispense paper from the writing implement. Many of the patents noted above disclose mechanisms for dispensing paper which are prone to undesired jamming or tearing of the paper, are difficult to load or unload, require complex threading of the paper, do not enable easy dispensation of the paper, and/or are extremely complex from a mechanical and cost-of-production standpoint. Some of what appear to be the more complex dispensing mechanisms among the patents cited earlier include those disclosed in U.S. Pat. No. 2,073,719 (see, e.g., FIG. 4); U.S. Pat. No. 2,224,470 (see, e.g., FIG. 4); U.S. Pat. No. 2,287,618 (see, e.g., FIG. 5); U.S. Pat. No. 2,601,650 (see, e.g., FIGS. 14–18); U.S. Pat. No. 3,963,358 (see, e.g., FIG. 13); and U.S. Pat. No. 4,812,069 (see, e.g., FIG. 6).

One of the problems is that in the above patents, the paper roll itself is unsecured at its ends, and thus tends to unravel inside the pen, especially as the paper supply is depleted and the paper has more room inside the pen barrel to unroll. This problem is partially resolved by. U.S. Pat. No. 1,266,299 to Moore, which uses a roll that has scores proximate its edges (along the line b') and is glued together along its edges (outside of the line b'). U.S. Pat. No. 2,512,168, also to Moore, uses a scoring similar to that of U.S. Pat. No. 1,266,299, but wherein the scoring converges as one approaches the center of the roll.

While this does help to secure the edges of the paper to prevent unraveling, it does not address the issue of how to peel off the outer layer of paper from the inner layers when it is desired to dispense some paper from the writing implement. Especially as the paper supply depletes, the outer surface winding of the rolls disclosed in U.S. Pat. Nos. 1,266,299 and 2,512,168 (and indeed, of the rolls in all of these patents) resides further from the edge of the writing implement barrel and the slot through which the paper is pulled, and it becomes more and more difficult the get the paper edges to protrude through the dispensing slot. Indeed, the basic problem is that as the roll is depleted, it becomes more important to secure the roll in such a way that it will not unravel inside the writing implement, and yet, by securing the roll precisely when it is depleted and thus its outer surface is further from the slot, it then becomes harder to "leaf off" the outer edge of the paper, through the slot.

It would therefore be desirable to have a simple mechanism for dispensing rolled paper from the barrel of a writing implement (or from a paper roll dispenser generally) that simultaneously secures the paper roll from unrolling inside the barrel while "leafing" up the outermost layer of the paper roll through the barrel slot for easy dispensation, especially when the paper supply is largely depleted.

SUMMARY OF INVENTION

A paper roll dispensing apparatus in accordance with the invention comprises outer winding separation and inner winding restraint means for restraining inner windings of the paper roll from unrolling while simultaneously separating an outer winding of said paper roll from its inwardly-adjacent winding, and tension-supplying means for pressing a restraining edge of the outer winding separation and inner winding restraint means against an outside layer of the paper roll, both when the paper roll is substantially full and as the paper roll becomes depleted.

Preferably, the paper roll also comprises tack adhesive means for adhering successive windings of the paper roll to one another when the outer winding is not pulled away from its inwardly-adjacent winding and simultaneously enabling the adhesion to be broken without substantial tearing of the paper when the outer winding is pulled away from its inwardly-adjacent winding. An embodiment in which induced curling of the paper is used to facilitate dispensing is also disclosed.

BRIEF DESCRIPTION OF DRAWINGS

The features of the invention believed to be novel are set forth in the appended claims. The invention, however, together with further objects and advantages thereof, may best be understood by reference to the following description taken in conjunction with the accompanying drawing in which:

DETAILED DESCRIPTION

Figure 1:
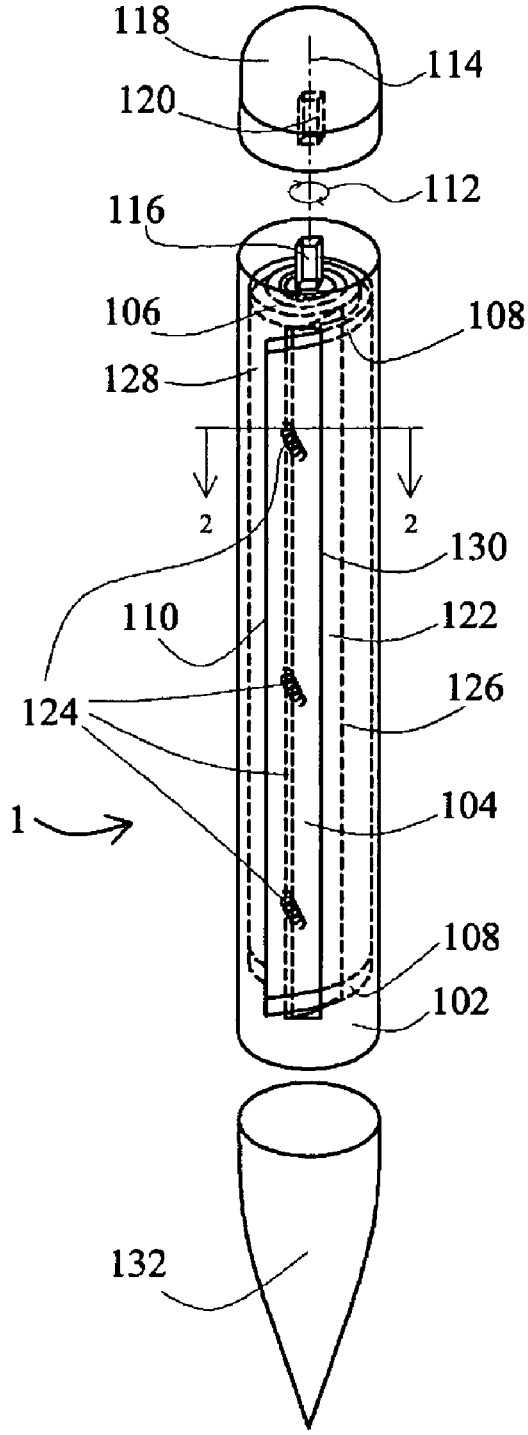
FIG. 1 is a mixed perspective and schematic view of a paper roll barrel for use in connection with, e.g., writing implements, in a preferred embodiment of the invention using a paper roll with tack adhesion.

FIG. 1 shows a paper roll dispenser 1 barrel in a preferred embodiment. Dashed lines are used to show visually-hidden elements. Dispenser case 102 comprises a paper roll dispensing aperture 104, similarly to the slots used in much of the prior art referenced above. Also similarly to the prior art, residing inside of dispenser case 102 is a paper roll 106. In a preferred embodiment, the successive paper windings of paper roll 106 are secured to one another preferably along their outer ends using a tack adhesive means 108 for providing sufficient adhesion between said successive windings when a leading edge 110 of paper roll 106 is not pulled away from its inwardly-adjacent windings and simultaneously enabling said adhesion to be broken without substantial tearing of the paper when leading edge 110 (i.e. the outermost winding) of paper roll 106 is pulled away from its inwardly-adjacent windings. (Please note that while tack adhesion along the outer ends is preferred, as will be discussed, the tack adhesive can in fact be used in other locations as well.) Quite suitable for tack adhesive means 108 is any adhesive means similar in character to the adhesive used in commonly-used Post-It® Notes, which allows successive sheets of paper to adhere to one another in a pad while awaiting use, and allows sheets to be removed from the pad without substantial tearing when said sheets are gently pulled away from the pad. In an alternative embodiment illustrated in FIG. 4, the paper ends are scored or similarly weakened for tearing along tearable lines 402, and are glued together along their outside edges using any suitable general adhesive means 404 for adhering said successive windings to one another, including adhesives stronger than tack adhesive means 108 which may thus not allow for separation from one winding to the next without tearing along tearable lines 402, similarly to the paper roll used in U.S. Pat. No. 1,266,299.

As in some of the prior art, paper roll 106 is dispensed through dispensing aperture 104 by rotating (112) paper roll 106 about its rotational axis 114 relative to dispenser case 102. Rotating 112 can be achieved by a variety of means known in the art including by rotating a spindle 116 running through rotational axis 114 of paper roll 106 using any suitable rotating means 118 such as the illustrated end cap with a spindle receptacle 120 mating with spindle 116. It is preferred, though not required, that rotating 112 be restricted to one direction only as schematically illustrated by the directional arrows on 112, using any of a variety of directional rotation restriction means known in the art for enforcing such one-way rotation. Even more preferably, rotating 112 should be fully unrestricted in one direction (the "unrolling" direction as illustrated), and restricted to a fractional part of a full rotation in the other ("rolling") direction. This allows unrestricted unrolling, but allows a user to roll the paper back up through, for example, not limitation, a quarter or eighth or sixteenth of a rotation but not any further for fine adjustments as may be needed from time to time.

Figure 4:
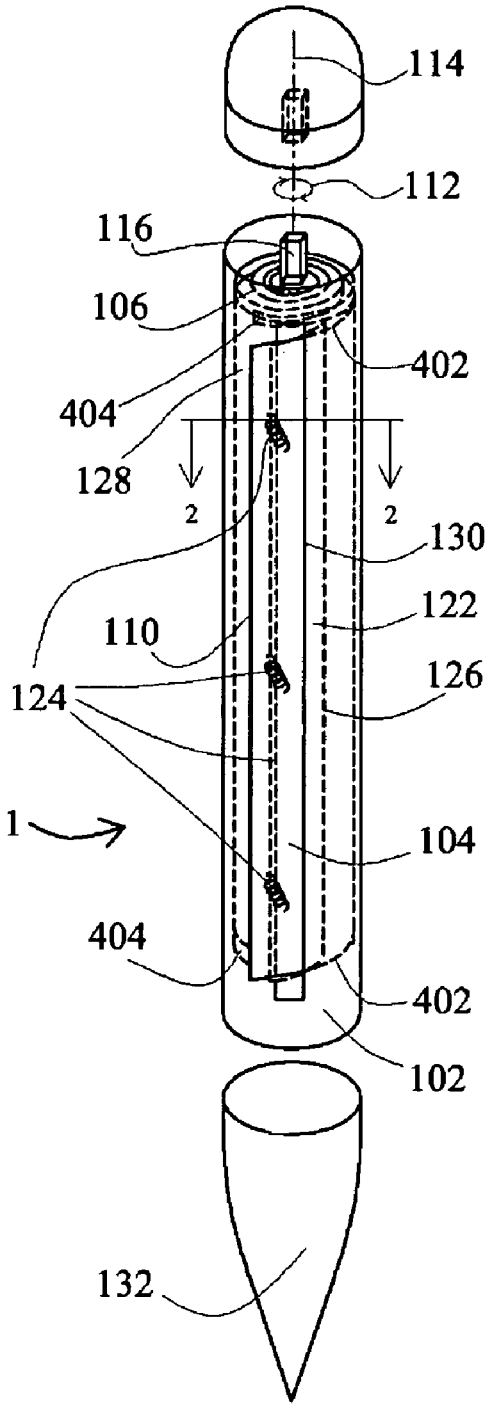
FIG. 4 is a mixed perspective and schematic view of a paper roll barrel for use in connection with, e.g., writing implements, in an embodiment of the invention using a paper roll with tearable lines.

Now, as discussed earlier, one problem in the prior art is that if successive windings of paper roll 106 are not secured to one another, preferably at their ends, the paper tends to unravel inside the pen, especially as the paper supply is depleted and the paper has more room inside dispenser case 102 to unroll. That is why it is preferred to employ tack adhesive means 108 as shown in FIG. 1, or alternatively tearable lines 402 in combination with general adhesive means 404 as shown in FIG. 4. But, as also discussed, this, by itself, does not address the issue of how to peel off the outer layer of paper from the inner layers when it is desired to dispense some paper from the writing implement, especially as the paper supply depletes and the outermost surface winding resides further from dispenser case 102 and dispensing aperture 104. That is, this addresses how to prevent the paper from unrolling when it is desired that the paper not unroll. But it does not address how to ensure that the leading edge 110 (i.e., the outermost winding) of the paper roll will unroll when it is desired to have this leading edge 110 unroll.

Figure 2:
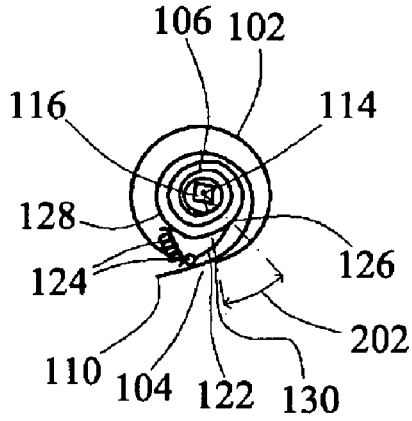
FIG. 2 is a cross sectional view if FIG. 1 taken along the line 2—2, when the paper roll is relatively full.

To resolve this problem, FIGS. 1, 2, 3 and 4 also discloses an outer winding separation and inner winding restraint means 122 for simultaneously restraining the inner windings from unrolling while causing the outer winding to separate from its inwardly-adjacent winding, in combination with tension-supplying means 124 for causing said outer winding separation and inner winding restraint means 122 to flex inward toward the rotational axis 114 as the paper supply is depleted. As a result of this tension-supplying means 124, a restraining edge 126 of outer winding separation and inner winding restraint means 122 will always press against the outside layer 128 of paper roll 106, both when paper roll 106 is full, and as paper roll 106 becomes depleted. At the same time, because leading edge 110 is threaded outside outer winding separation and inner winding restraint means 122, the placement of outer winding separation and inner winding restraint means 122 between leading edge 110 and outside layer 128 will always cause the outermost winding to separate from the rest of paper roll 106 as paper roll 106 is rotated in the unrolling direction. This is seen by contrasting FIGS. 2 and 3. In FIG. 2, when paper roll 106 is substantially full, outer winding separation and inner winding restraint means 122 is angled such that its restraining edge 126 is further from rotational axis 114, while in FIG. 3, when paper roll 106 is relatively depleted, outer winding separation and inner winding restraint means 122 is angled such that its restraining edge 126 is closer to rotational axis 114. In all cases, outer winding separation and inner winding restraint means 122 is angled such that its restraining edge 126 presses against outside layer 128 of paper roll 106. Note also the preferred (but not required) concave curvature of outer winding separation and inner winding restraint means 122 as viewed from rotational axis 114.

Finally, it is to be observed that once a desired length of paper has been dispensed, this desired length is severed from paper roll 106 by tearing against a cutting edge 130 of dispensing aperture 104, as is the case in much of the prior art discussed above. (Cutting edge 130 may contain a blade (with due consideration for safety), serrations, or any similar reasonable paper severing means known in the art for safely effecting such severing.)

After severing, leading edge 110 will reside proximate cutting edge 130 and will not protrude substantially out of dispensing aperture 104. It is important for leading edge 110 to remain proximate dispensing aperture 104 after severing so that it will be accessible next time it is desired to dispense more paper. It is thus to be observed from the cross-sectional FIG. 2 that there is an overlap region 202 through which outer winding separation and inner winding restraint means 122 overlaps with a region of dispenser case 102 adjacent cutting edge 130. In FIG. 2, overlap region 202 circumscribes an approximately 30 degree overlap angle with a fairly full roll, but this overlap angle can be varied as desired to be any angle greater than 10 degrees and any angle less than 120 degrees for a full paper roll, recognizing that this angle will decrease slightly as the roll is depleted and outer winding separation and inner winding restraint means 122 becomes more sharply angled relative to dispenser case 102. If the concave curvature of outer winding separation and inner winding restraint means 122 is suitably chosen, the overlap angle can be made a large as 180 degrees, so that outer winding separation and inner winding restraint means 122 actually spirals around part of the paper roll. The preferred magnitude of this overlap angle is greater than 15 degrees, and less than 75 degrees, with an optimum minimum of 30 degrees and an optimum maximum of 60 degrees. So long as leading edge 110 remains within overlap region 202 after severing, it will in fact remain accessible for when it is next desired to dispense more paper.

In the event that rotating 112 is optionally restricted to a fractional part of a full rotation in the "rolling" direction as noted earlier, using suitable one-directional rotation restriction means known or obvious in the art for allowing free rotation in the unrolling direction while restricting the rotation in the rolling direction, the fractional rotation allowed in the restricted direction should be less than the angle of overlap region 202 for an empty paper roll 106. This ensures that once the paper is severed, the severed edge of the paper will always remain within overlap region 202 between outer winding separation and inner winding restraint means 122 and dispenser case 102, and cannot be wound back into the roll past restraining edge 126. This in turn ensures that the leading edge 110 of paper roll 106 is always in optimum position for dispensing, the next time such dispensing is desired. Thus, if overlap angle 202 is, say, 45 degrees (i.e., one eighth of a full revolution) for a full paper roll (the state of affairs in FIG. 2), then any back-winding allowed in the restricted direction should be less than 45 degrees.

However, even if back-winding (turning in the winding direction) is completely unrestricted (which is allowable but less preferred), it will always be possible to bring leading edge 110 out through dispensing aperture 104 simply through forward winding (turning in the unwinding direction). In particular, even if leading edge 110 is wound all the way back, the fact that restraining edge 126 always presses against the outside layer 128 of paper roll 106 no matter how full is paper roll 106 will cause restraining edge 126 to "leaf" under leading edge 110 as paper roll 106 is wound forward in the unwinding direction and peel it back off from the remainder of paper roll 106. Once this occurs, further forward winding through the angle of overlap region 202 will naturally cause leading edge 110 to emerge from dispensing aperture 104.

Figure 3:
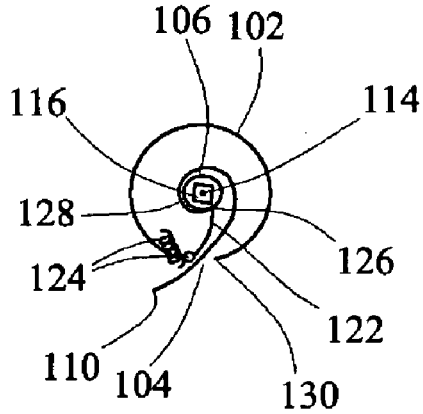
FIG. 3 is the same cross sectional view as is FIG. 2, but is taken when the paper roll is relatively depleted.

Because tension-supplying means 124 presses restraining edge 126 of outer winding separation and inner winding restraint means 122 against outside layer 128 of paper roll 106, both when paper roll 106 is substantially full as in FIG. 2 and as paper roll 106 becomes depleted as in FIG. 3, paper roll 106 is effectively restrained from unrolling inside of dispenser case 102, even in the absence of tack adhesive means 108 (FIG. 1) or general adhesive means 404 combined with tearable lines 402 (FIG. 4). However, when tack adhesive means 108 or general adhesive means 404 combined with tearable lines 402 are included as well, then the paper roll 106 itself inherently will not unroll unless it is actively encouraged to do so, and so one does not need to depend exclusively upon outer winding separation and inner winding restraint means 122 to prevent this unrolling inside of dispenser case 102.

In FIG. 1, while tack adhesive means 108 is illustrated along the outer ends of paper roll 106, tack adhesive means 108 can in fact be located at other points too, including in the middle regions of paper roll 106. Indeed, tack adhesive means 108 can cover substantially the entirety of paper roll 106, since restraining edge 126 is designed to "leaf" under leading edge 110 as paper roll 106 is wound forward in the unwinding direction and peel leading edge 110 back off from the remainder of paper roll 106. The use of tack adhesive means 108 in regions other than, or in addition to, the outer ends of paper roll 106, provides additional assurance that paper roll 106 will not unroll inside of dispenser case 102, and that leading edge 110 will only leaf off when it is desired to leaf it off. Further, in the FIG. 1 embodiment, restraining edge 126 is preferably designed to press against the entire length of paper roll 106, including the tack adhesive 108 regions, since the paper will separate without substantial tearing along the tack regions as well as the non-tack regions.

This is one of the benefits of using the tack adhesive means 108 of FIG. 1 over the general adhesive means 404 combined with tearable lines 402 of FIG. 4. Particularly, in the FIG. 4 embodiment, where actual tearing takes place and there is no tack adhesive, one really is constrained to securing the paper from unwinding only along its edges. The use of general adhesive means 404 combined with tearable lines 402 in other regions of paper roll 106 would cause tearing along those other regions, which would not be desirable unless one wanted to tear the paper into two or more strips. Also note that in the FIG. 4 embodiment, restraining edge 126 must be designed to only press against and leaf under the non-adhered regions of paper roll 106, since the adhered regions do not separate and leafing under these regions would thus not be desirable. In other words, for the FIG. 4 embodiment, restraining edge 126 is located to press against the outside layer 128 of paper roll 106 only in regions of paper roll 106 where successive windings are not adhered to one another. In the FIG. 1 embodiment, restraining edge 126 may be located to press against the outside layer 128 of paper roll 106 in at least one region of paper roll 106 where successive windings are adhered to one another. While recognizing that the embodiment of FIG. 1 is thus preferred, the embodiment of FIG. 4 nevertheless remains an acceptable embodiment.

As a general rule, it is desirable to design paper roll dispenser 1 to accept either type of paper roll, i.e., either the FIG. 1 or the FIG. 4 type paper roll 106. Thus, of one sticks to using a tack or general adhesive along only the outer ends of paper roll 106, restraining edge 126 should be designed to only press against and leaf under the non-adhered regions of paper roll 106, so that either type of paper roll may be employed.

At this point, we turn to examine tension-supplying means 124 in some further detail. From a functional viewpoint, the key purpose of tension-supplying means 124 is to supply tension to press restraining edge 126 of outer winding separation and inner winding restraint means 122 against the outside layer 128 of paper roll 106, both when paper roll 106 is substantially full and as paper roll 106 becomes depleted. Any tension-supplying means 124 which achieves this functional objective is considered to be within the scope of this disclosure and its associated claims, and it is for this reason that tension-supplying means 124 is schematically illustrated in FIGS. 1 through 4 with a "spring" coil next to a circular "hinge."

Figure 5:
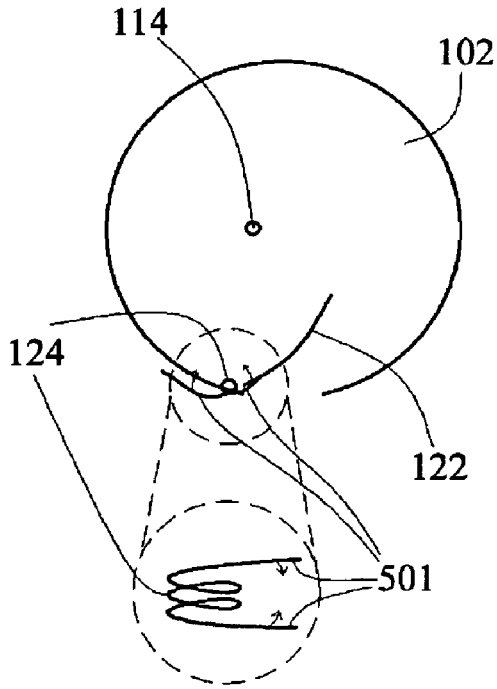
FIG. 5 is a mixed plan and exploded perspective view illustrating a non-limiting, mechanically-based exemplary implementation of a tension-supplying means that aids in both restraining and separating paper from the paper roll in accordance with the invention.

FIG. 5 now illustrates a specific, non-limiting, exemplary implementation of tension-supplying means 124, which is mechanically-based. In this implementation, one uses an actual spring in which the spring tension is supplied, not by the stretching of the spring, but by the curling of the spring about its longitudinal axis. The mechanism operates similar to a door hinge that not only allows for the door to rotate thereabout, but also supplies a spring tension that causes the door to automatically close when the door is not being purposefully held open. Thus, outer winding separation and inner winding restraint means 122 is attached to dispenser case 102 via a hinge proximate spring 124, and spring 124 itself pushes outer winding separation and inner winding restraint means 122 toward the rotational axis 114 via outer spring armatures 501 which press against dispenser case 102 and outer winding separation and inner winding restraint means 122 so as to exert a force in the direction of the unnumbered directional arrows in FIG. 5. While the spring shown in FIG. 5 "pushes" against dispenser case 102 and outer winding separation and inner winding restraint means 122, one could with equal ease within known art use the spring to "pull" dispenser case 102, and/or to "pull" outer winding separation and inner winding restraint means 122. Indeed, for a mechanical implementation of tension-supplying means 124, wherein tension-supplying means 124 comprises mechanical means for pressing restraining edge 126 against said outside layer 128 of paper roll 106, any form of spring-type hinge known in the art is considered to be within the scope of this disclosure and its associated claims, irrespective of the nature of the source of the spring tension, irrespective of where it is located along or with respect to the hinge, and irrespective of the precise nature of the hinge.

While the implementation of FIG. 5 is mechanically based, it is to be clearly understood that tension-supplying means 124 can also be materially based. Particularly, there are a broad range of flexible materials known in the materials arts which can be bent somewhat out of shape, and which will spring back to their original state when the force causing the bending is later removed. For example, not limitation, this includes a wide range of flexible plastics, spring-steels, rubberized materials, mylar, and similar materials. Thus, it is to be understood that outer winding separation and inner winding restraint means 122 may be constructed, in whole, or in part (particularly proximate where outer winding separation and inner winding restraint means 122 joins with dispenser case 102), out of a material that serves the functional objective of supplying tension to press restraining edge 126 of outer winding separation and inner winding restraint means 122 against the outside layer 128 of paper roll 106, both when paper roll 106 is substantially full and as paper roll 106 becomes depleted. An outer winding separation and inner winding restraint means 122 that is materially based can be fabricated in a unitary manner together with dispenser case 102, or can be fabricated as a separate component that is then attached to dispenser case 102. In either event, outer winding separation and inner winding restraint means 122 comprises tension-supplying means 124; and tension-supplying means 124 comprises materially-based means for pressing restraining edge 126 against outside layer 128 of paper roll 106. It is again to be understood that such a materially-based implementation, in addition to or alternatively to a mechanically-based implementation, is encompassed by the schematic illustration of tension-supplying means 124 in FIGS. 1 and 4.

A writing means 132 for producing written markings (such as a pen head with ink, a pencil head with pencil lead, a marking head with any type marking dye, etc.), attachable to paper roll dispenser 1 is also illustrated in FIGS. 1 and 4, for context. But, it is understood that the use of paper roll dispenser 1 dispensing papers as heretofore described need not necessarily be restricted only to a combination with a writing head 132. Indeed, any tubular instrument from which one wishes to dispense rolled paper can utilize this disclosure to more effectively dispense said rolled paper, and all such combinations of the paper roll dispenser 1 disclosed herein with implements that serve purposes and objects other than writing and marking are considered to be within the scope of this disclosure and its associated claims. This includes, but is not limited to: pointers, flashlights, thermometers, measuring implements, and other implements. This also includes a simple paper dispenser 1 standing alone that is uncombined with any other implement.

Figure 6:
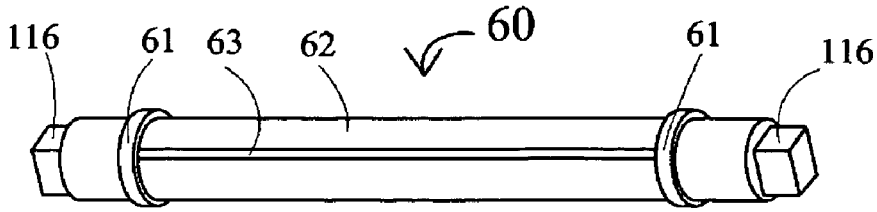
FIGS. 6–8 are perspective views illustrating a paper roll assembly for use in all embodiments of the invention, but particularly for the embodiment illustrated in FIGS. 10–13.
Figure 7:
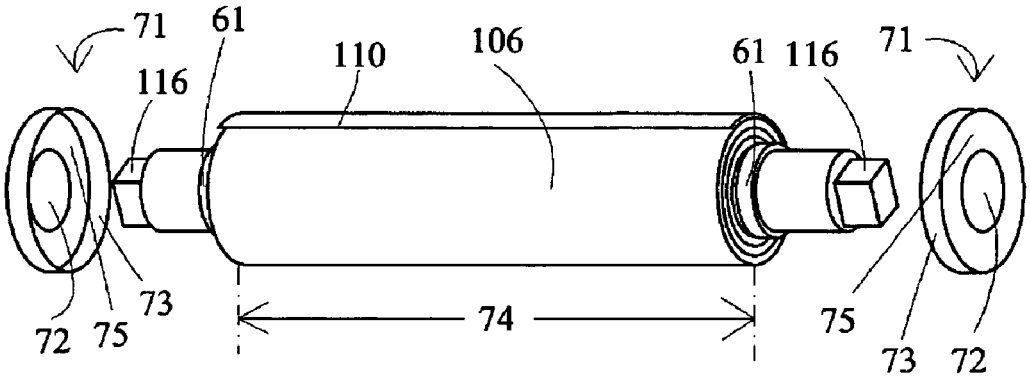
Figure 8:
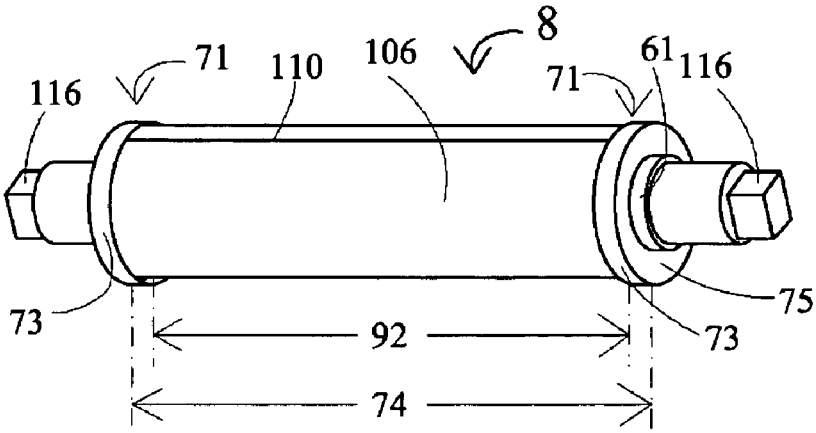

FIGS. 6–13 illustrate yet another embodiment of the invention which averts the need for the tack adhesive means 108 from the embodiment of FIGS. 1–3 or the tearable lines 402 from the embodiment of FIGS. 4–5. FIG. 6 illustrates a paper winding core 60 around which paper roll 106 is wound in this embodiment. Paper winding core 60 comprises spindle 116 which is rotated using any suitable rotating means 118 (see FIG. 12) just is in the earlier embodiments, a paper winding region 62, and a pair of retention cap stops 61 closely outside the edges of paper winding region 62. Also illustrated is a paper winding slot 63 for receiving the trailing (innermost) edge of paper roll 106 to hold the paper in place during winding and avoid slippage once the paper is wound about paper winding region 62 of paper winding core 60. Tapes or adhesives may also be used alternatively to, or to supplement, paper winding slot 63. As now illustrated in FIG. 7, paper roll 106 is threaded into paper winding slot 63 similarly to how film is wound into a takeup reel when loading film into in a photographic camera, and then wound around paper winding region 62 until taut. Then, cap apertures 72 of pair of flexible paper retention caps 71 are slid over the outer ends of paper winding core 60. The cap apertures 72 are slightly smaller in diameter than the diameters of retention cap stops 61, but because paper retention caps 71 comprise a flexible elastomer, they are flexible enough to widen as they are drawn over and past retention cap stops 61, and to recontract thereafter. In the end, paper retention caps 71 are held in place between the ends of paper roll 106 and retention cap stops 61, as shown in FIG. 8. Paper retention caps 71 each comprise a securing lip 73 which as shown in FIG. 8 moves over and secures the ends of paper roll 106 in place as shown. As noted, paper retention caps 71 comprise a flexible elastomer. This is an elastomer such as, but not limited to, a flexible rubber or plastic. While not limiting, the elastomer used for paper retention caps 71 should be in the 60 A to 95 A or 45 D to 75 D range on the scale customarily used in the art to rate the flexibility of elastomers. Since there is some overlap in these scales, the range is effectively 60 A to 75 D, and an optimum flexibility is approximately 95 A. Elastomers in this range also have a degree of frictional character associated with them, and this frictional character, combined with the capacity the elastomer to set securely over the ends of paper roll 106, serves to restrain the ends of paper roll 106 and thus maintain paper roll 106 in place as shown in FIG. 8. Note that in this way, paper retention caps 71 serve the same function for restraining the ends of paper roll 106 that was served by the tack adhesive means 108 from the embodiment of FIGS. 1–3 and the tearable lines 402 from the embodiment of FIGS. 4–5. In suitable configuration, the assembly of paper roll 106 wound about paper winding core 60 and restrained at its ends by paper retention caps 71 can be utilized in connection with the dispenser cases 102 of FIGS. 1–5 in the manner described earlier. But, this assembly is also used in connection with the curl-inducing dispenser case 91 of FIG. 9, to be discussed below.

Figure 9:
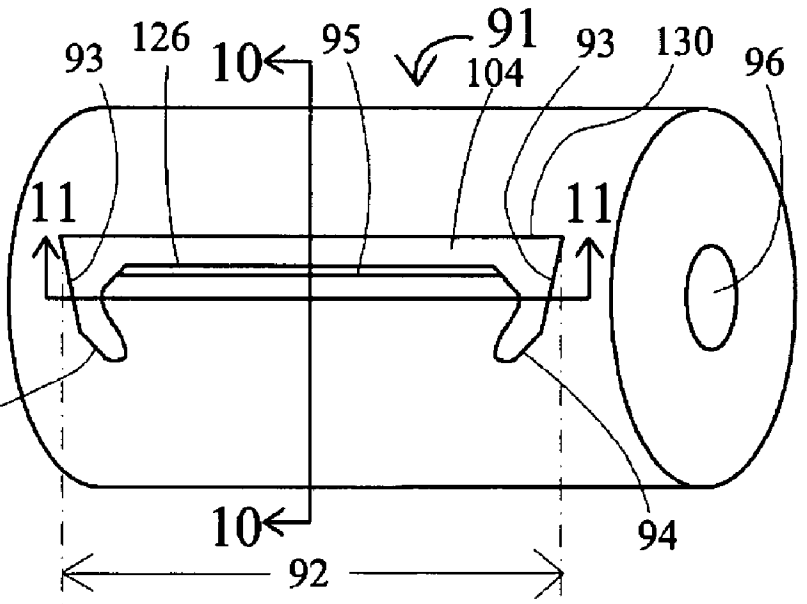
Figure 11:
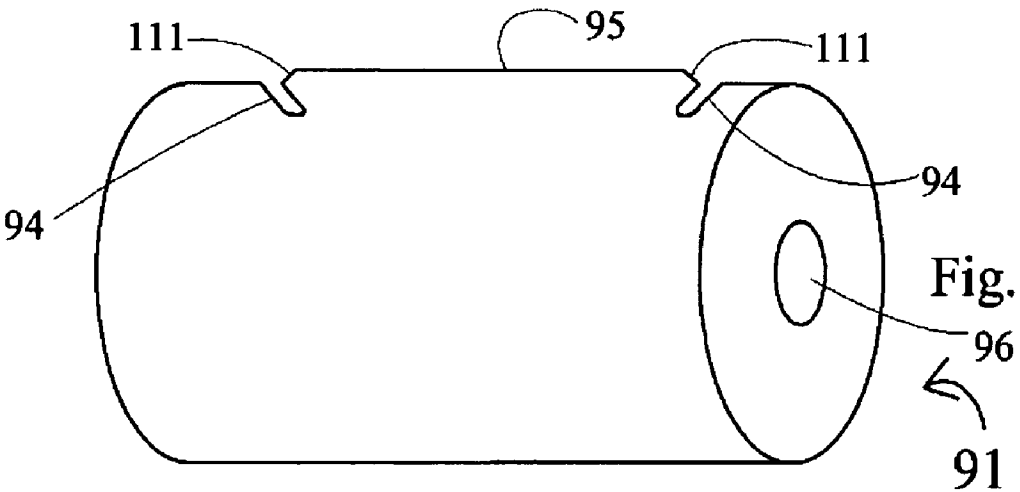

In the embodiment of FIG. 9, paper roll dispensing aperture 104 is sized and shaped to draw and curl the edges of paper roll 106 inward as paper roll 106 is being dispensed, which in experimental testing has proven to be a very effective approach for dispensing paper. At the outset, it is noted that the length 92 of paper roll dispensing aperture 104 is smaller than the length 74 of paper roll 106. (Note, the cap faces 75 of paper retention caps 71 are regarded to have negligible thickness, which is why reference numeral 74 is shown in both FIGS. 7 and 8.) In fact, the outer length 92 of paper roll dispensing aperture 104 is approximately equal to the distance between the inside edges of securing lips 73, as shown by the reference numeral 92 in both FIGS. 8 and 9. Because the length 92 of paper roll dispensing aperture 104 is smaller than the length 74 of paper roll 106, the edges of paper roll 106 will of necessity be drawn inward into a curl as paper roll 106 is being dispensed; the issue now becomes one of properly controlling this curl.

Figure 10:
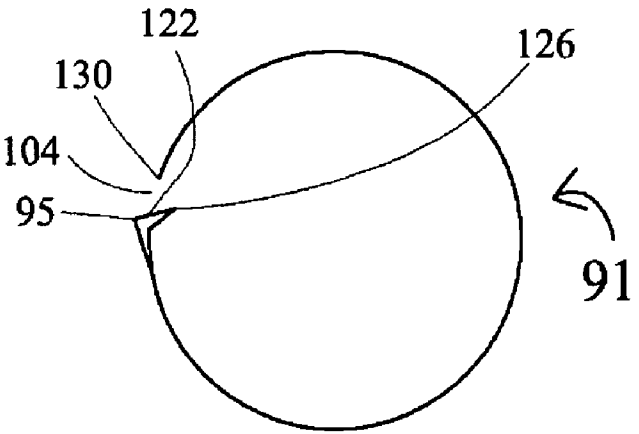
FIGS. 9–11 are perspective views illustrating a curl-inducing dispenser case employed in an embodiment of the invention in which induced curling of the paper is used to facilitate dispensing.

There are several elements in the configuration of curl-inducing dispenser case 91 which combine to effectively unroll the leading edge of paper roll 106 for dispensing, and to bring about a suitable curling of paper roll 106 as it is being dispensed. FIG. 10, which shows a cross section of FIG. 9 along the view 10—10, illustrates a restraining edge 126 of outer winding separation and inner winding restraint means 122, just as in the earlier embodiments of FIGS. 1–5. However, in this embodiment, tension-supplying means 124 is not necessary, and outer winding separation and inner winding restraint means 122 does not need to flex inward toward the rotational axis 114 as the paper supply is depleted. Instead, restraining edge 126 is fixed in position, and it is the curling of paper roll 106 which keeps the paper properly-situated for dispensing at all times. Referring to all of FIGS. 9–11, paper roll dispensing aperture 104 comprises a lateral paper drawing angle 93 for drawing the paper inward as paper roll 106 is forwardly rotated within curl-inducing dispenser case 91. Paper roll dispensing aperture 104 further comprises a horizontal curl-inducing angle 94 larger (more inwardly-oriented) than and adjacent to lateral paper drawing angle 93. Paper roll dispensing aperture 104 further comprises a curl-inducing vertical elevation 95 which is best seen by cross-referencing FIG. 9 with the 10—10 cross section of FIG. 10 and the 11—11 cross section of FIG. 11. Finally, paper roll dispensing aperture 104 further comprises a vertical curl-inducing angle 111 which is visible in the 11—11 cross section of FIG. 11. As lateral paper drawing angle 93 and horizontal curl-inducing angle 94 and the smaller length of 92 of paper roll dispensing aperture 104 compared to the larger length 74 of paper roll 106 draw the paper inward and induce a curl in the paper horizontally (laterally and inwardly) with respect to the plane of the paper by inducing the side ends of paper roll 106 to move laterally and inwardly with respect to a plane of the paper, simultaneously, vertical elevation 95 and vertical curl-inducing angle 111 induce a curl in the paper vertically (perpendicularly and upwardly) with respect to the plane of the paper by inducing the middle of the paper to move upwardly while allowing the side ends of the paper roll 106 to lag.

Figure 12:
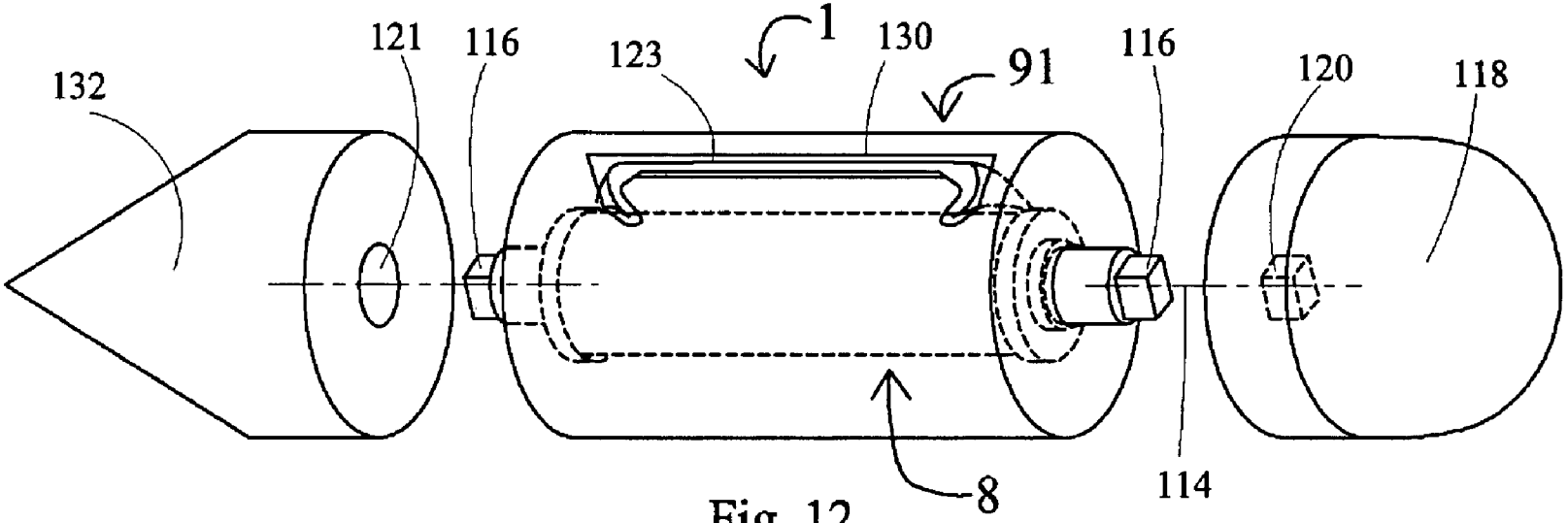
FIGS. 12–13 are perspective and schematic cross-sectional views respectively, illustrating the dispensing of paper in the curl-inducing embodiment.
Figure 13:
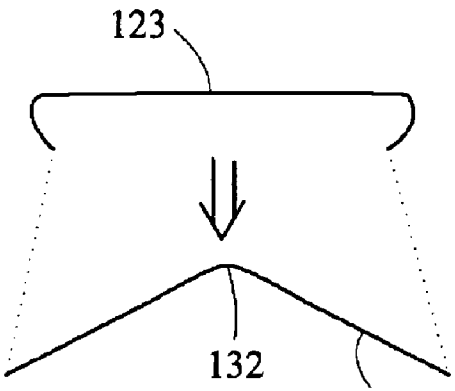

All of these features combine to produce a suitable curling as illustrated in FIGS. 12 and 13. In particular, the paper roll assembly 8 of FIG. 8 is inserted into curl-inducing dispenser case 91 through a suitable passageway in the left side of curl-inducing dispenser case 91. As in the previous embodiments, spindle 116—which passes through a paper winding aperture 96—is rotated by engaging any suitable rotating means 118, with writing means 132 also suitably-mated to paper roll dispenser 1 as previously discussed. Note the support aperture 121 engaging and supporting the left end of paper winding core 60 leaving it free to rotate. If only forward motion is desired, a ratcheting or similar one-way mechanism to prevent paper from being rolled back into the writing implement once it has been unrolled can be employed as well proximate support aperture 121, as discussed previously.

Once everything is assembled as in FIG. 12 with the leading edge 110 of paper roll 106 engaging restraining edge 126 (which in this embodiment serves to peel away leading edge 110), the paper roll is rotated in a forward dispensing direction. As stated above, lateral paper drawing angle 93 and horizontal curl-inducing angle 94 and the shorter length of 92 of paper roll dispensing aperture 104 compared to the longer length 74 of paper roll 106 draw the paper inward and induce a curl in the paper horizontally (laterally and inwardly) with respect to the plane of the paper by inducing the side ends of paper roll 106 to move laterally and inwardly with respect to a plane of the paper, while simultaneously, vertical elevation 95 and vertical curl-inducing angle 111 induce a curl in the paper vertically (perpendicularly and upwardly) with respect to the plane of the paper by inducing the middle of the paper to move upwardly while allowing the side ends of the paper roll 106 to lag. That is, a curl is simultaneously induced laterally and inwardly with respect to the plane of the paper, and also perpendicularly and upwardly with respect to the plane of the paper. As the paper passes through paper roll dispensing aperture 104, the paper curls with an inverted end-hook cross-section 123 shown in FIG. 12 and shown separately in FIG. 13 for clearer illustration. As the leading edge 110 of paper roll 106 moves out away from paper roll dispensing aperture 104, it forms into the wide inverted-v cross section 131. The v-junction at 132 creates a "tenting" effect, and serves to stabilize the paper as it is dispensed. When a desired length of paper has been dispensed, this desired length is severed from paper roll 106 by tearing against a cutting edge 130, just as in the previous embodiments.

While only certain preferred features of the invention have been illustrated and described, many modifications and changes will occur to those skilled in the art. It is, therefore, to be understood that the appended claims are intended to cover all such modifications and changes as fall within the true spirit of the invention.

The invention claimed is:

1. A paper roll dispensing system, comprising:

a paper roll dispenser comprising a paper roll dispensing aperture thereof;

a paper winding core within said paper roll dispenser, comprising a paper winding region thereof; and a pair of elastomeric paper retention caps each comprising a securing lip for securing side ends and outer ends of a paper roll wound about said paper winding region and situated so that said paper roll can be passed through said paper roll dispensing aperture.

2. The apparatus of claim 1, wherein:

at least one of said paper retention caps slides over said outer end of said paper winding core.

3. The apparatus of claim 2, further comprising said paper roll wound around said paper winding region, with said side ends of said paper roll secured by said securing lips.

4. The apparatus of claim 1, wherein:

at least one of said paper retention caps slides over said outer end of said paper winding core and is retained by said paper winding core with its securing lip securing said side ends of said paper roll.

5. The apparatus of claim 4, further comprising said paper roll wound around said paper winding region, with said side ends of said paper roll secured by said securing lips.

6. The apparatus of claim 1, further comprising said paper roll wound around said paper winding region, with said side ends of said paper roll secured by said securing lips.

7. A method for dispensing paper roll, comprising the steps of:

introducing a wound paper roll about a paper winding region of a paper winding core;

securing side ends and outer ends of said paper roll about said paper winding region using a pair of securing lips of a pair of elastomeric paper retention caps each comprising one of said securing lips; and situating the paper winding core, paper roll and retention cap combination within a paper roll dispenser so that said paper roll can be passed through a paper roll dispensing aperture of said paper roll dispenser.

8. The method of claim 7, further comprising the step of:

sliding at least one of said paper retention caps over said outer end of said paper winding core.

9. The method of claim 7, further comprising the steps of:

sliding at least one of said paper retention caps over said outer end of said paper winding core; and retaining said at least one of said paper retention caps with its securing lip securing said side ends of said paper roll, using said paper winding core.

* * * * *